US011976535B1

(12) United States Patent
Hicks et al.

(10) Patent No.: US 11,976,535 B1
(45) Date of Patent: May 7, 2024

(54) SLEEVE AND PLUG SYSTEM AND METHOD

(71) Applicant: Republic Oil Tools LLC, Oklahoma City, OK (US)

(72) Inventors: Robert Hicks, Oklahoma City, OK (US); Josh Prather, Millsap, TX (US)

( * ) Notice: Subject to any disclaimer, the term of this patent is extended or adjusted under 35 U.S.C. 154(b) by 0 days.

(21) Appl. No.: 18/102,314

(22) Filed: Jan. 27, 2023

(51) Int. Cl.
*E21B 34/14* (2006.01)
*E21B 43/12* (2006.01)

(52) U.S. Cl.
CPC ..... *E21B 34/142* (2020.05); *E21B 43/128* (2013.01)

(58) Field of Classification Search
CPC ..... E21B 34/142; E21B 43/128
See application file for complete search history.

(56) References Cited

U.S. PATENT DOCUMENTS 6,595,295 B1 * 7/2003 Berry ..... E21B 43/128 166/105
10,392,910 B2 * 8/2019 Walton ..... E21B 34/103

* cited by examiner

*Primary Examiner* — Crystal J Lee
(74) *Attorney, Agent, or Firm* — McAfee & Taft

(57) ABSTRACT

An artificial lift assembly and method relating thereto where a sleeve system is disposed above an electrical submersible pump. The sleeve system has a sliding sleeve at least partially carried within a ported case. The sliding sleeve blocks fluid flow through ports in the ported case. The sliding sleeve is restricted from movement relative to the ported case until a first predetermined pressure is applied to the sliding sleeve. Subsequent to the operating the electrical submersible pump, a plug is introduced to the sliding sleeve so as to block fluid flow through the sliding sleeve, Subsequent to introducing the plug, fluid pressure above the plug is increased until the sliding sleeve moves relative to the ported case such that fluid flow is allowed through the ports. Thereafter removing the artificial lift assembly from the wellbore.

15 Claims, 5 Drawing Sheets

SLEEVE AND PLUG SYSTEM AND METHOD

FIELD

The present disclosure relates generally to artificial lift assemblies using electrical submergible pumps (ESP), and in particular, to sealing devices used in relation to ESP systems.

BACKGROUND

In subsurface wells, such as oil wells, an electrical submersible pump with a motor (ESP) is often used to provide an efficient form of artificial lift to assist with lifting the production fluid to the surface. ESPs decrease the pressure at the bottom of the well allowing for more production fluid to be produced to the surface than would otherwise be produced if only the natural pressures within the well were utilized.

The typical electrical submersible pump installation consists of a downhole gauge (sensor) to monitor pressure and temperature, connected to a motor that drives a single or double seal, also known as a protector. The protector inhibits oil ingress into the motor while permitting pressure equalization between the well annulus and motor connected to the downhole pump, typically a centrifugal pump but sometimes a progressing cavity pump, or other centrifugal or positive displacement pumps. Historically, the motor has been a 2-Pole Induction motor that has existed in the marketplace for over fifty years.

Recently, the use of permanent magnet motors has come to the forefront for use in electrical submersible pumping (ESP) in oil and gas wells. Replacing the induction motor with a permanent magnet motor is new to the oil and gas industry and offers several benefits including a higher efficiency, power factor, and increased reliability. The foundation of a permanent magnet motor is that it utilizes rare earth magnets in the rotor to enable better synchronization with the electrical current flowing through the stator thereby increasing the efficiency and power factor.

One of the pitfalls with permanent magnet motors is that during installation or pump removal, the wellbore equalizes pressure through the pump which causes rotation of the pump and subsequently the motor. When the motor spins, the magnets within the rotor spin thereby generating power which is transmitted up the cable to the surface. This can present safety issues caused by technicians being unaware that the pumping system is spinning downhole and transmitting electrical power to the surface.

SUMMARY

This disclosure generally concerns an ESP system and method relating thereto. The system is designed to prevent rotation of the pump, and subsequently the motor, such as during removal of the ESP system from the wellbore.

More specifically, in accordance with one series of embodiments of the current disclosure, there is provided an artificial lift assembly deployed on a tubing string for use in a wellbore. The artificial lift assembly comprising an electrical submersible pumping system having a permanent magnet motor, and a sleeve system. The sleeve system is disposed above the electrical submersible pump. The sleeve system has a sliding sleeve at least partially carried within a ported case, wherein the sliding sleeve blocks fluid flow through ports in the ported case. The sliding sleeve is restricted from movement relative to the ported case until a first predetermined pressure is applied to the sliding sleeve. Further, a plug is configured to engage with the sliding sleeve so as to block fluid flow through the sliding sleeve and thus enable an increase in fluid pressure above the plug in the wellbore to the first predetermined pressure so as to move the sliding sleeve relative to the ported case such that fluid flow is allowed through the ports. For example, the plug can be a ball plug or a wellbore dart.

In embodiments where the plug is a wellbore dart, the dart can have an outer profile defined on an outer surface of the wellbore dart. The outer profile can be configured to mate with the sliding sleeve such that, when the wellbore dart is introduced into the sliding sleeve, the wellbore dart is held in place within the sliding sleeve and prevents fluid flow through the electrical submersible pumping system to thus prevent rotation of the permanent magnet motor by the fluid flow.

In some embodiments, the wellbore dart is configured to have a first portion and a second portion. The first portion and the second portion are configured to be lockingly engaged and disengageable, and by disengaging the first portion from the second portion, the wellbore dart is removable from the sliding sleeve.

Further, the wellbore dart can comprise an outer collet tubing. The outer collet tubing forms the outer profile. The outer collet tubing having a plurality of collet fingers which have a radially inward position and a radially outward position, and the radially outward position prevents upward movement of the wellbore dart when it is within the sliding sleeve. Additionally, the wellbore dart can have an inner dart mandrel configured to move the collet fingers to the radially outward position. The outer collet tubing can have an upper end having a shoulder and wherein the shoulder interacts with the sliding sleeve so as to prevent downward movement of the wellbore dart past the sleeve.

Additionally, the wellbore dart can have one or more polymeric sealing sections defined on an outer surface. The sealing sections provide a fluid-tight seal with the inner surface of the sliding sleeve.

In accordance with this disclosure, there is provided a method of using the above described artificial lift assemblies. The method comprising:

- introducing into a wellbore the artificial lift assembly on a tubing string;
- operating the electrical submersible pump within the wellbore;
- subsequent to operating the electrical submersible pump, introducing the plug to the sliding sleeve so as to block fluid flow through the sliding sleeve and thus enabling an increase in fluid pressure above the plug in the wellbore;
- subsequent to introducing the plug, increasing the fluid pressure above the plug until the first predetermined pressure is applied to the sliding sleeve so that the sliding sleeve moves relative to the ported case such that fluid flow is allowed through the ports; and
- thereafter removing the artificial lift assembly from the wellbore.

In embodiments, when the sliding sleeve has moved relative to the ported case to allow fluid flow through the ports, the movement to allow fluid flow allows fluid to drain through the ports from above the sleeve system so as to allow removal of the artificial lift assembly from the wellbore without fluid flow through the electrical submersible pump.

In embodiments where the plug is a ball plug, the ball plug can land on the sliding sleeve so as to block fluid flow from entering the electrical submersible pump from above the artificial lift assembly.

In embodiments where the plug is a dart, the dart can lodge in the sliding sleeve so as to block fluid flow through the electrical submersible pump from both above and below the artificial lift assembly.

In embodiments where the mating of the outer profile with the sleeve locks the dart within the sliding sleeve so as to prevent removal, the method can further comprise, after removing the artificial lift assembly from the wellbore, disengaging a first portion of the dart from a second portion of the dart so as to unlock the dart from the sliding sleeve and allow removal of the dart from the sliding sleeve. Thereafter; the dart is removed from the sliding sleeve.

BRIEF DESCRIPTION OF THE DRAWINGS

The description and embodiments are discussed with reference to the following figures. However, the figures should not be viewed as exclusive embodiments. The subject matter disclosed herein is capable of considerable modifications, alterations, combinations, and equivalents in form and function, as will be evident to those skilled in the art with the benefit of this disclosure.

FIG. 6 is a cross-sectional view of the system illustrated in FIG. 5 with the sleeve now in the second position.

DETAILED DESCRIPTION

Figure 1:
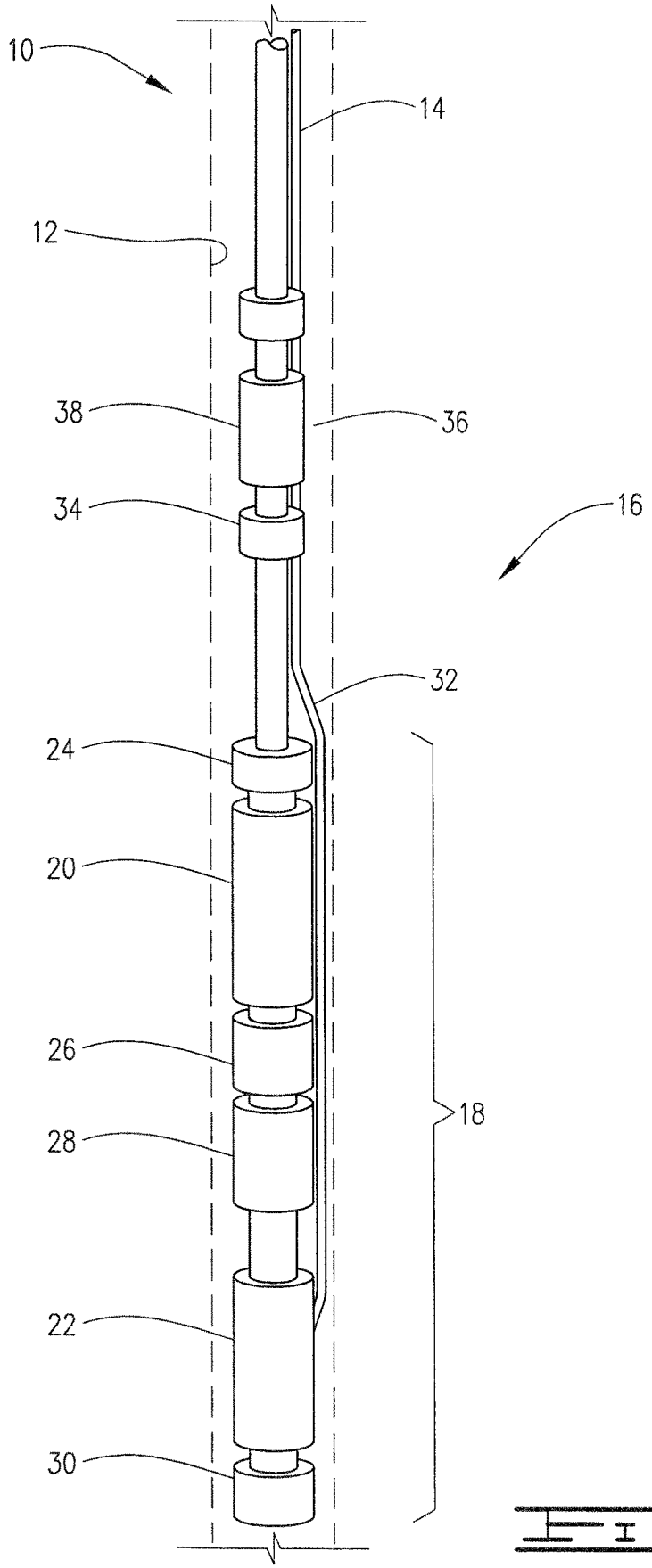
FIG. 1 schematically shows an artificial lift assembly on a tubing string in a wellbore.

In the description that follows, like parts are marked throughout the specification and drawings with the same reference numerals, respectively. The drawings are not necessarily to scale and the proportions of certain parts have been exaggerated to better illustrate details and features of the invention. Where components of relatively well-known designs are employed, their structure and operation will not be described in detail.

In the following description, the terms "inwardly" and "outwardly" are directions toward and away from, respectively, the geometric axis of a referenced object. Further, the invention will be described below with respect to an artificial lift assembly deployed on a tubing string in a wellbore, beginning at the bottom of the well and working upwards. Accordingly, reference to up or down will be made for purposes of description with "up," "upper," "upward," "upstream" or "above" meaning toward the surface and with "down," "lower," "downward," "down-hole," "downstream" or "below" meaning toward the subsurface terminal end of the wellbore, regardless of the wellbore orientation.

In the following discussion and in the claims, the terms "having," "including" and "comprising" are used in an open-ended fashion, and thus should be interpreted to mean "including, but not limited to . . ." Where words such as "consisting" or "consisting essentially of" shall be used in a closed-ended fashion. Finally, embodiments using the open-ended wording will be understood to also include embodiments using the closed-ended wording.

Referring now to FIG. 1, a well 10 comprises a wellbore 12, which may include a casing cemented therein. A tubing string 14 is lowered into wellbore 12. The exterior of tubing string 14 and the wall of wellbore 12 form an annulus 36. An artificial lift assembly 16 is deployed on tubing string 14 for use in wellbore 12. Artificial lift assembly 16 has an electrical submersible pump (ESP) 18, which includes at least a pump 20 and a permanent magnet motor 22. ESP 18 may also include components such as a discharger 24, gas separator section 26, seal section 28 and optional sensors 30, which are generally known in the art.

Pump 20 can be any of several typical pumps used for artificial lift assemblies, such as a centrifugal pump or a progressive cavity pump. While the artificial lift assembly 16 described herein can be used with any appropriate downhole motor, it is especially beneficial with permanent magnet motor 22, where the currently described artificial lift assembly 16 can help prevent unwanted discharges of electrical energy up power cable 32 when the ESP 18 is not being operated.

During operation of ESP 18, power cable 32 provides electrical power from the surface that drives the permanent magnet motor 22 and hence drives the pump 20 to increase production of fluid from a subsurface reservoir. When ESP 18 is not being operated (such as when artificial lift assembly 16 is being introduced into wellbore 12 or taken out of wellbore 12), flow through pump 20 can cause rotation of pump 20 and in turn rotation of the permanent magnet in motor 22, which generates electrical energy. This electrical energy can be transmitted uphole to the surface by power cable 32 causing a safety hazard. Artificial lift assembly 16, as further described below, prevents such unwanted electrical energy transmission.

To prevent unwanted rotation during introduction into the wellbore, artificial lift assembly 16 can include an optional rupture disc 34 as further explained in U.S. Pat. No. 11,365,597, issued Jun. 21, 2022.

For additionally control of fluid through the ESP 18—such as when the ESP is removed from the wellbore the system can include a sleeve system 38, which is typically uphole from ESP 18.

Figure 2:
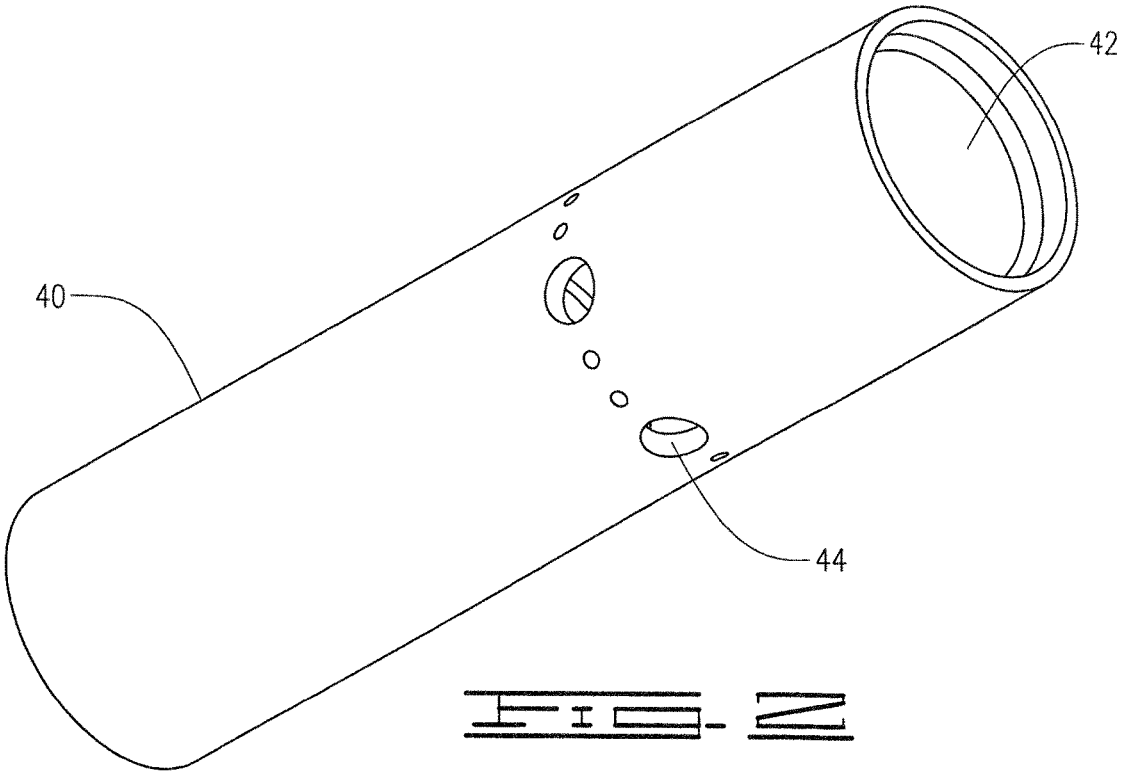
FIG. 2 is a perspective view of a ported case in accordance with embodiments of this disclosure.
Figure 3:
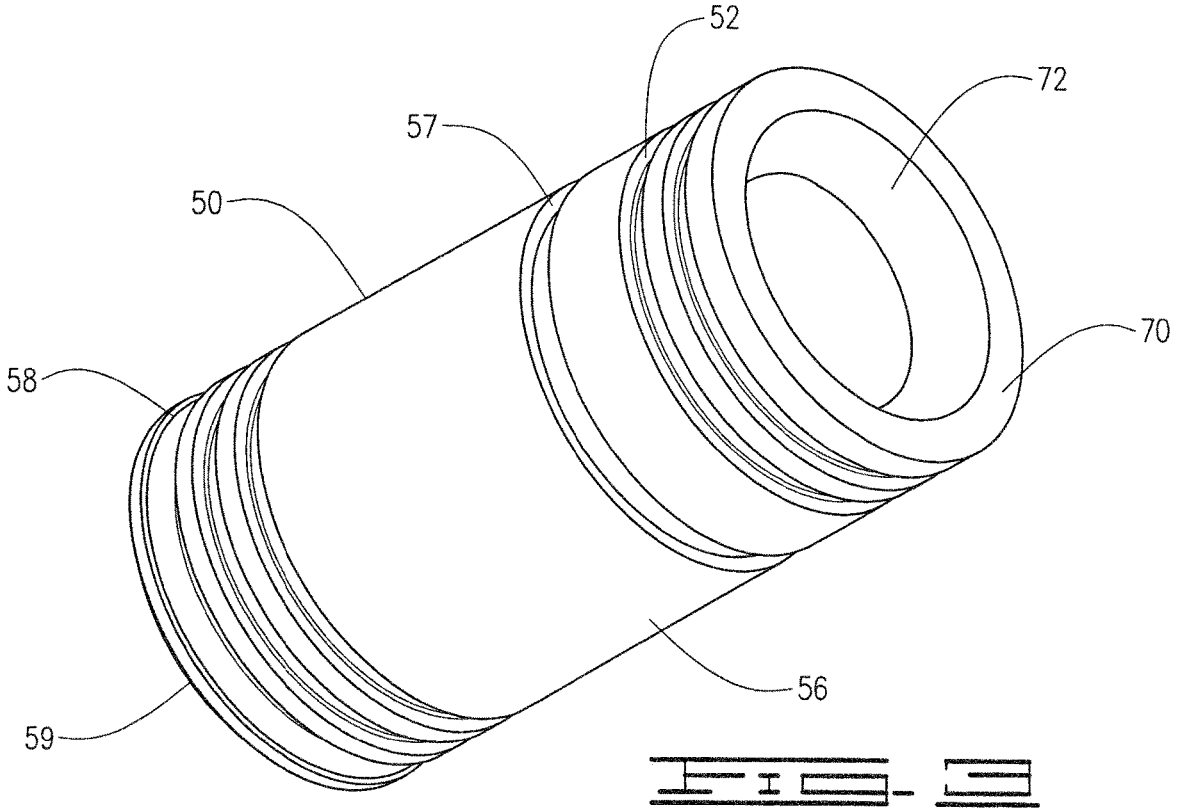
FIG. 3 is a perspective view of a sliding sleeve suitable for use in the ported case of FIG. 2.
Figure 4:
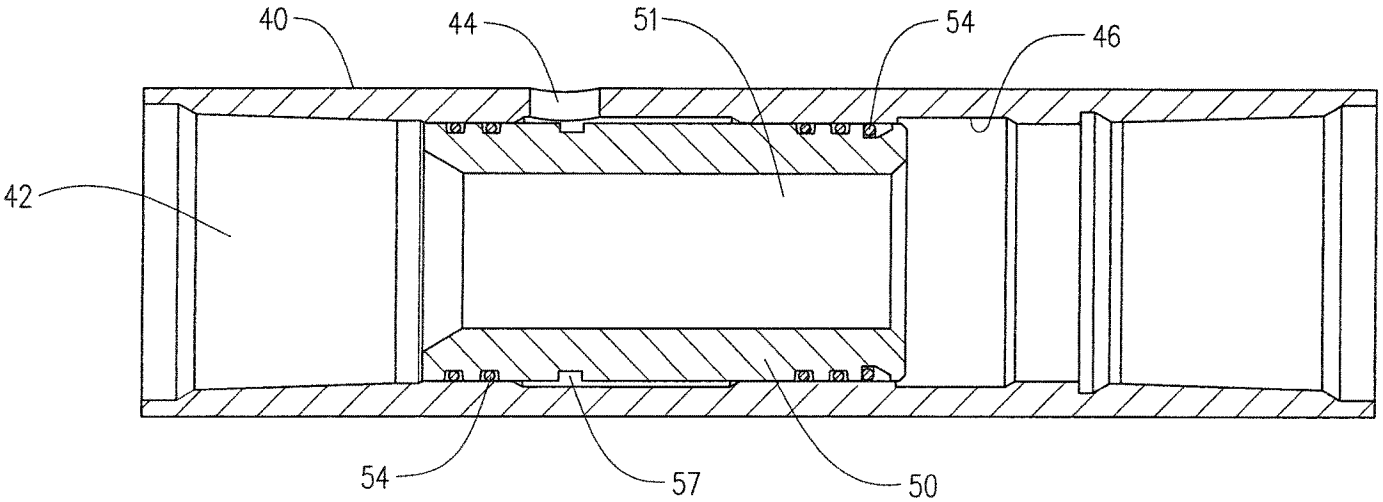
FIG. 4 is a sectional view of a ported case with a slidable sleeve positioned inside.

Sleeve system 38 can be better seen in FIGS. 2, 3 and 4. Sleeve system 38 is typically located in the tubing string 14 above the ESP 18. Although sleeve system 38 is shown above rupture disc 34 in FIG. 1, sleeve system 38 can be located below rupture disc 34 instead.

Sleeve system 38 comprises a ported case 40 and sliding sleeve 50. Ported case 40 forms an outer portion of the tubing stream. Ported case 40 defines a longitudinal bore 42 and one or more ports 44 which provide fluid flow between bore 42 and the exterior of ported case 40. Exterior to ported case 40 is annulus 36. Sliding sleeve 50 is configured to be housed within ported case 40, such that it is at least partially carried within ported case 40.

Sliding sleeve 50 defines a longitudinal bore 51 and has exterior grooves 52 extending circumferentially around its exterior. Grooves 52 receive seal rings 54 so as to have a sealing engagement with the interior surface 46 of ported case 40, thus preventing fluid flow between the outer surface 56 of sliding sleeve 50 and the interior surface 46 of ported case 40. When housed within ported case 40, sliding sleeve 50 has a first position in which fluid flow through ports 44 is blocked, illustrated in FIGS. 4 and 5. Also, sliding sleeve 50 has a second potion in which fluid flow through ports 44 is allowed, illustrated in FIG. 6. Sliding sleeve 50 is restricted from movement relative to the ported sleeve until a first predetermined pressure is applied to the sliding sleeve. For example, a rupture band can be placed in groove 57. The rupture band maintains sliding sleeve 50 in the first position until a pressure equal to or greater than the first predetermined pressure is asserted. In other embodiments, a ridge 58 at a lower end 59 of sliding sleeve 50 is used instead of rupture band, as further explained below.

As will be realized from the drawings, fluid flow through sleeve system 38 is solely through bore 51 when sliding sleeve 50 is in its first position within ported case 40. Further, fluid flow from uphole within the tubing string is prevented from passing into annulus 36 in the first position. Fluid flow through bore 51 can be prevented by introducing a plug at least partially into sliding sleeve 50. For example, the plug can be a ball plug. Further, once the plug is in place, fluid pressure within the tubing string above sleeve system 38 can be increased until it is at least the predetermined pressure at which time sliding sleeve 50 will move into the second position. Once in the second position, sliding sleeve 50 allows fluid flow from uphole in the tubing string to pass through ports 44 into the annulus.

As indicated above, in some embodiments outward projecting ridge 58 maintains sliding sleeve in the first position by engaging with a first groove 48 on then interior surface 46 of ported case 40. Once the predetermined pressure is reached, ridge 58 is forced out of first groove 48 and moves to second groove 49 formed in the interior surface. When ridge 58 reaches second groove 49, sliding sleeve 50 is in the second position, and ports 44 are exposed. The interaction of ridge 58 and second groove 49 maintains the sliding sleeve in the second position and prevents it from moving uphole or downhole from the second position.

While a ball plug will prevent flow down hole through sleeve system 38 and the ESP, and can facilitate movement of the sliding sleeve from the first position to the second position, a ball plug will typically allow fluid flow through the tubing string and through the ESP when the fluid flow comes from below the ESP. In instances where it is desired to prevent such upward flow of fluid through the ESP, a suitable mating wellbore dart can be used as the plug.

One such suitable mating wellbore dart 60 is illustrated in FIGS. 5-9. Wellbore dart 60 has an outer profile 62 defined on an outer surface of wellbore dart 60. Outer profile 62 is configured to mate with sliding sleeve 50 such that, when wellbore dart 60 is introduced into sliding sleeve 50, wellbore dart 60 is held in place within sliding sleeve 50 and prevents upward and downward fluid flow through the electrical submersible pumping system to thus prevent rotation of the permanent magnet motor by the fluid flow.

Figure 5:
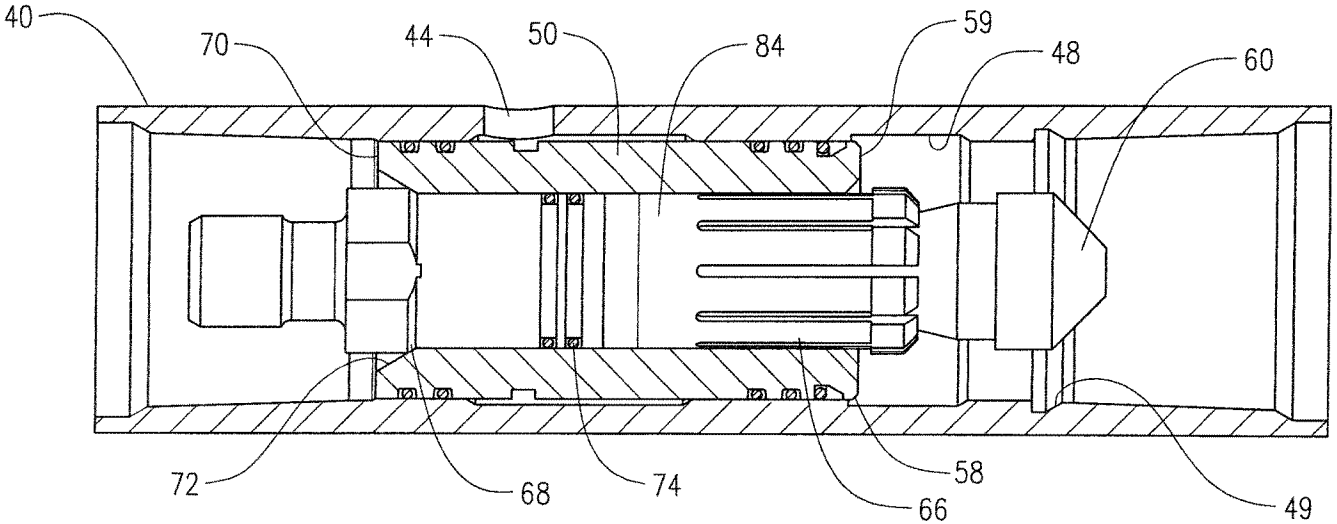
FIG. 5 is a sectional view of the ported case and sleeve illustrated in FIG. 4 wherein a plug has been introduced in accordance with some embodiments of this disclosure. The sleeve is in the first position.
Figure 5:
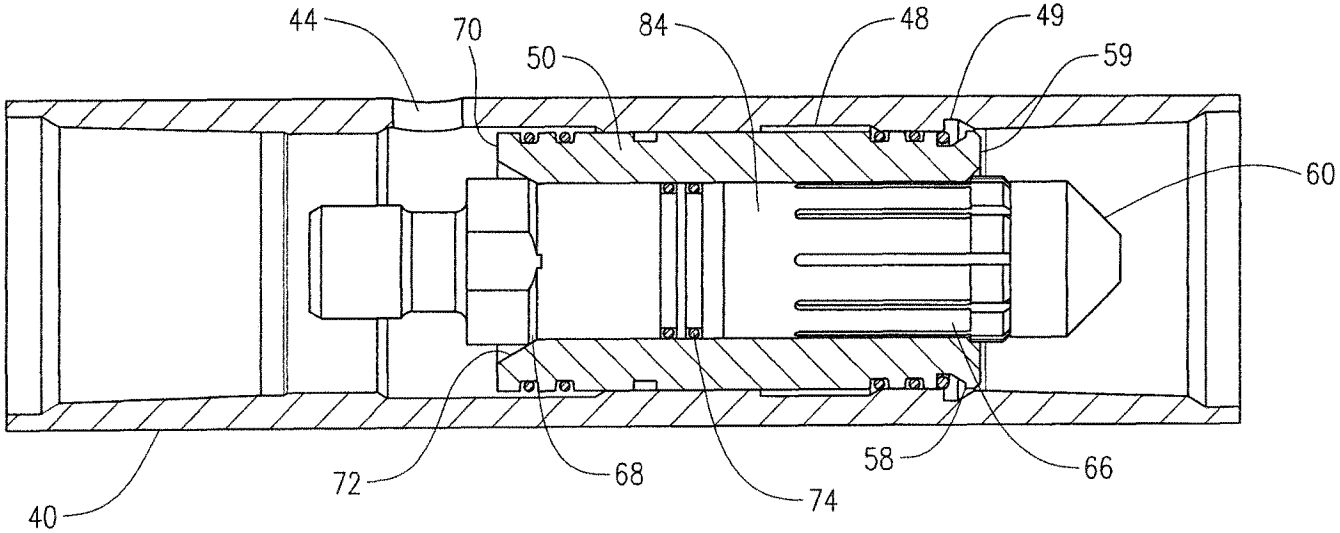
Figure 7:
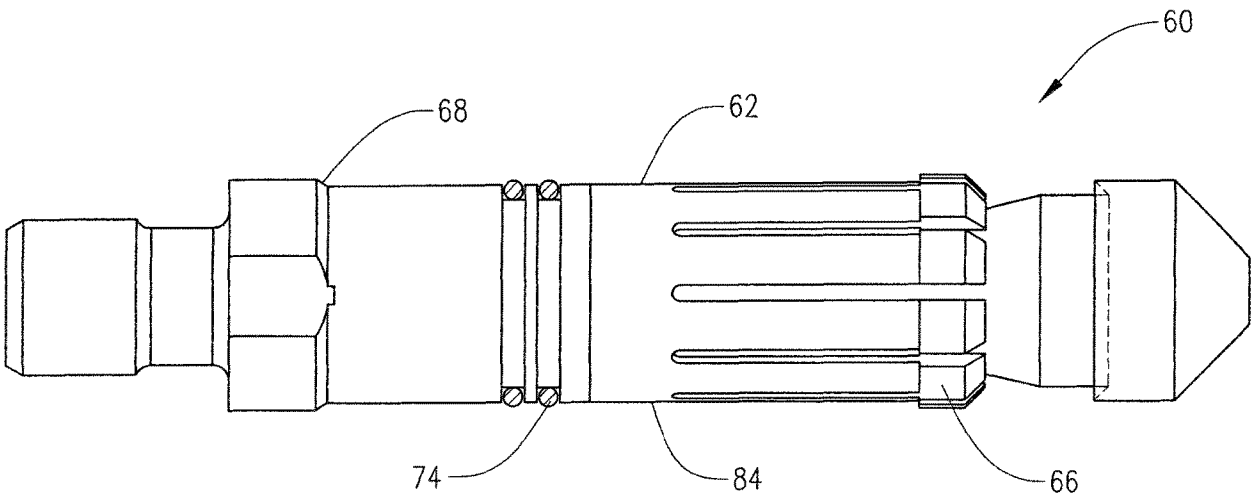
FIG. 7 is a illustration of the an embodiment of the plug, which better illustrates its features.

For example, the embodiment of wellbore dart 60 illustrated in FIGS. 5-7 includes a plurality of collet fingers 66 defined on or forming a part of outer surface. Collet fingers 66 are outwardly biased and interact with a lower end 59 of sliding sleeve 50 so as to lock wellbore dart 60 from moving upward in sliding sleeve 50, and thus in ported case 40 and tubing string 14. Inward projecting shoulder 44 is part of inner profile 40 of inner surface 42 of sleeve 38. Further, sliding sleeve 50 can have an upper end 70 having a shoulder 72 which mates with an opposing shoulder 68 on wellbore dart 60 so as to prevent downward movement of the wellbore dart 60 past the sliding sleeve 50. In this manner, wellbore dart 60 is locked into place within sliding sleeve 50.

When wellbore dart 60 is locked into place within sliding sleeve 50, one or more polymeric sealing rings 74, which are in grooves on outer surface 64 are placed in sealing contact with inner surface 46 of sliding sleeve 50 so as to provide a fluid-tight seal.

Figure 8:
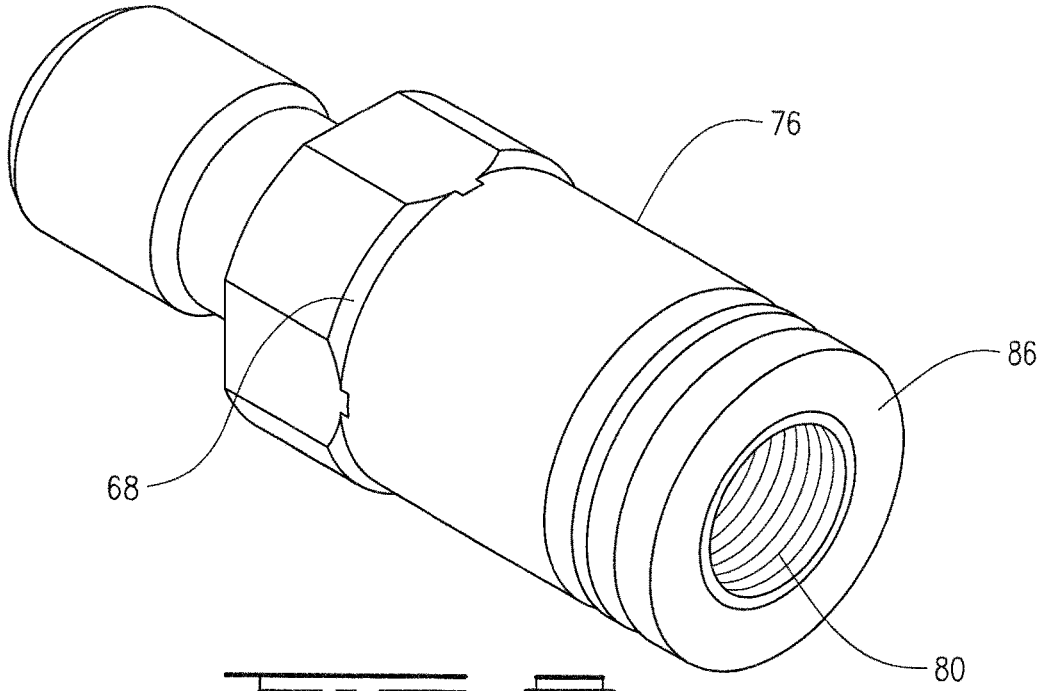
FIG. 8 is perspective view of the first portion of the plug illustrated in FIG. 7.
Figure 9:
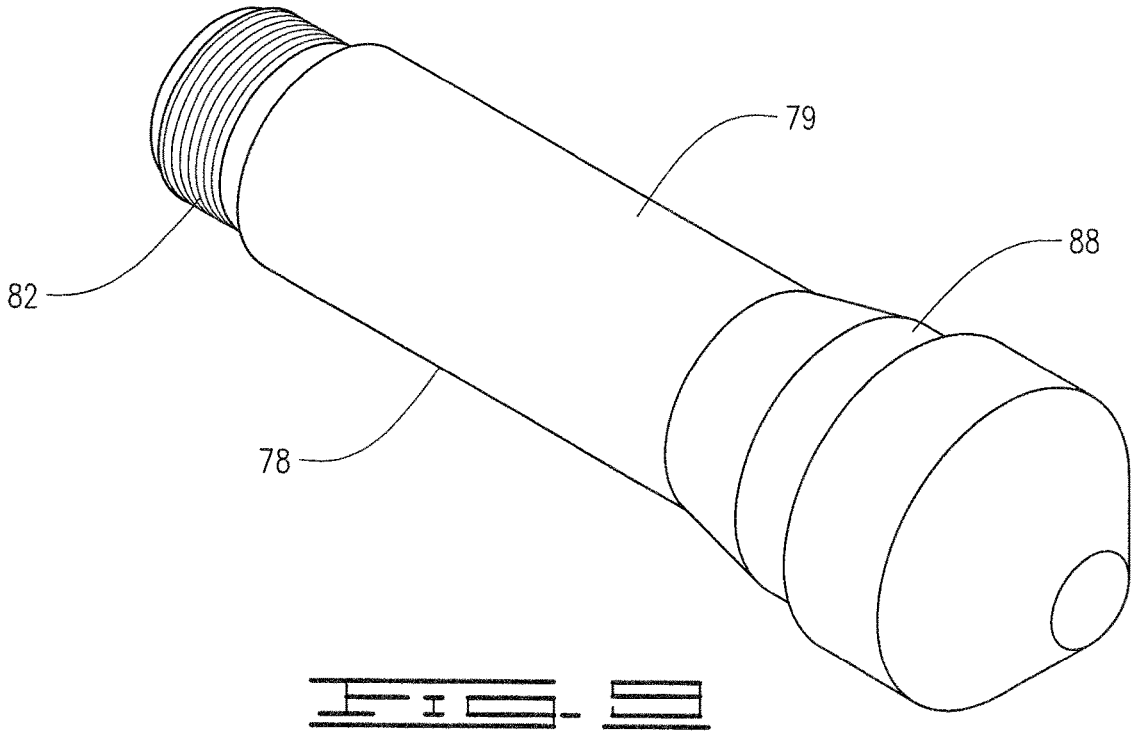
FIG. 9 is a perspective view of the second portion of the plug illustrated in FIG. 7.

Referring to FIGS. 8 and 9, in embodiments wellbore dart 60 is configured to have a first portion 76 and a second portion 78. First portion 76 and second portion 78 are configured to be lockingly engaged and disengageable. For example, they can be connected using mating threads 80 and 82. By disengaging first portion 76 from second portion 78, the wellbore dart is removable from sliding sleeve 50. In such embodiments, collet 66 can be a cylindrical collar or tubing 84 that sides onto mandrel 79 of second portion 78, and when second portion 78 is attached to first portion 76, collar 84 is held in place between a lower end 86 of the first portion 76 and head 88 of second portion 78. Head 78 of second portion 78 can an angle surface so as to facilitate movement of collet fingers 66 form a radially inward position to a radially outward position. In the radially outward position, the collet fingers 66 interact with lower end 59 of sliding sleeve 50 so as to prevent upward movement of the dart relative to the sliding sleeve.

Additionally, it is within the scope of this disclosure for there to be multiple sleeve systems in tubing string 14, which accept different sizes of wellbore darts. Generally, a higher sleeve system will use a large diameter wellbore dart than a lower sleeve system so that the wellbore darts that mate with a lower sleeve system can pass through the higher sleeve system.

In operation, artificial lift assembly 16 is introduced into wellbore 12 on tubing string 14. When artificial lift assembly 16 is being introduced, rupture disc 34 (if used) is in an unruptured state so as to prevent fluid flow through electrical submersible pumping system 18 to thus prevent rotation of permanent magnet motor 22 by the fluid flow during introduction of artificial lift assembly 16. Additionally, wellbore dart 60 has not been introduced into sliding sleeve 50.

After artificial lift assembly 16 is introduced into the wellbore and positioned therein, rupture disc 34 is ruptured to allow fluid flow through electrical submersible pumping system 18. ESP 18 can now be operated to bring well fluids uphole to the surface.

After ESP operation is complete and it is desired to remove the artificial lift assembly 16 from the wellbore 12, a plug or wellbore dart 60 is introduced into the wellbore 12 such that wellbore dart 60 engages sliding sleeve 50 and prevents fluid flow through the electrical submersible pumping system 18 to thus prevent rotation of the permanent magnet motor 22 by fluid flow. Wellbore dart 60 can be dropped downhole to engage sliding sleeve 50 or can be pumped down by fluid pressure into engagement with sliding sleeve 50.

After wellbore dart 60 is in place, fluid pressure above the dart/plug is increased until at least the predetermined pressure is applied to the sleeve system. At this point, sliding sleeve 50 moves relative to the ported case 40 such that fluid flow is allowed through ports 44. The fluid flow through the ports allows fluid to drain from above the sleeve system so as to allow removal of the artificial lift assembly from the wellbore without fluid flow through the electrical submersible pump. Thereafter, the artificial lift assembly and sleeve system can be removed from the wellbore.

After removal of the artificial lift assembly from the wellbore, the first portion 76 of the dart is removed from the second portion 78 of the dart so as to unlock the dart from the sliding sleeve and allow removal of the dart from the sliding sleeve.

The above elements of the tool as well as others can be seen with reference to the figures. From the above description and figures, it will be seen that the present invention is well adapted to carry out the ends and advantages mentioned, as well as those inherent therein. While the presently preferred embodiment of the apparatus has been shown for the purposes of this disclosure, those skilled in the art may make numerous changes in the arrangement and construction of parts. All such changes are encompassed within the scope and spirit of the appended claims.

What is claimed is:

1. A method comprising:

introducing into a wellbore an artificial lift assembly on a tubing string, wherein the artificial lift assembly comprises:

an electrical submersible pump having a permanent magnetic motor; and a sleeve system disposed above the electrical submersible pump, the sleeve system having a sliding sleeve at least partially carried within a ported case, wherein the sliding sleeve blocks fluid flow through ports in the ported case, and the sliding sleeve is restricted from movement relative to the ported case until a first predetermined pressure is applied to the sliding sleeve;

operating the electrical submersible pump within the wellbore;

subsequent to the operating the electrical submersible pump, introducing a plug to the sliding sleeve so as to block fluid flow through the sliding sleeve and thus enabling an increase in fluid pressure above the plug in the wellbore;

subsequent to introducing the plug, increasing the fluid pressure above the plug until the first predetermined pressure is applied to the sliding sleeve so that the sliding sleeve moves relative to the ported case such that fluid flow is allowed through the ports; and thereafter removing the artificial lift assembly from the wellbore.

2. The method of claim 1, wherein when the sliding sleeve has moved relative to the ported case to allow fluid flow through the ports, the movement to allow fluid flow allows fluid to drain through the ports from above the sleeve system so as to allow removal of the artificial lift assembly from the wellbore without fluid flow through the electrical submersible pump.

3. The method of claim 1, wherein the plug is a ball plug that lands on the sliding sleeve so as to block fluid flow from entering the electrical submersible pump from above the artificial lift assembly.

4. The method of claim 1, wherein the plug is a dart that lodges in the sliding sleeve so as to block fluid flow through the electrical submersible pump from both above and below the artificial lift assembly.

5. The method of claim 4, wherein the wellbore dart has an outer profile defined on an outer surface of the wellbore dart, the outer profile configured to mate with the sliding sleeve such that the wellbore dart is held in place within the sliding sleeve and prevents the fluid flow through the electrical submersible pumping system to thus prevent rotation of the permanent magnet motor by the fluid flow.

6. The method of claim 5, wherein the mating of the outer profile with the sliding sleeve locks the dart within the sliding sleeve so as to prevent removal, and wherein the method further comprises: after removing the artificial lift assembly from the wellbore, disengaging a first portion of the dart from a second portion of the dart so as to unlock the dart from the sliding sleeve and allow removal of the dart from the sliding sleeve; and thereafter, removing the dart from the sliding sleeve.

7. The method of claim 6, wherein the dart comprises: an outer collet tubing forming the outer profile, the outer collet tubing having a plurality of collet fingers which have a radially inward position and a radially outward position, and the radially outward position prevents upward movement of the dart when it is within the sliding sleeve; and an inner dart mandrel configured to move the collet fingers to the radially outward position.

8. The method of claim 7, wherein the inner dart mandrel is comprised of the first portion and the second portion, and wherein the first portion and the second portion are configured to be lockingly engaged and disengageable, and by disengaging the first portion from the second portion, the inner dart mandrel is removable from the outer collet tubing to thus allow the dart and the outer collet tubing to be removed from the sliding sleeve.

9. An artificial lift assembly deployed on a tubing string for use in a wellbore, the artificial lift assembly comprising:

an electrical submersible pumping system having a permanent magnet motor;

a sleeve system disposed above the electrical submersible pump, the sleeve system having a sliding sleeve at least partially carried within a ported case, wherein the sliding sleeve blocks fluid flow through ports in the ported case, and the sliding sleeve is restricted from movement relative to the ported case until a first predetermined pressure is applied to the sliding sleeve; and a plug configured to engage with the sliding sleeve so as to block fluid flow through the sliding sleeve and thus enable an increase in fluid pressure above the plug in the wellbore to the first predetermined pressure so as to move the sliding sleeve relative to the ported case such that fluid flow is allowed through the ports.

10. The artificial lift assembly of claim 9, wherein the plug is a wellbore dart having an outer profile defined on an outer surface of the wellbore dart, the outer profile configured to mate with the sliding sleeve such that, when the wellbore dart is introduced into the sliding sleeve, the wellbore dart is held in place within the sliding sleeve and prevents fluid flow through the electrical submersible pumping system to thus prevent rotation of the permanent magnet motor by the fluid flow.

11. The artificial lift assembly of claim 10, wherein the wellbore dart is configured to have a first portion and a second portion, and wherein the first portion and the second portion are configured to be lockingly engaged and disengageable, and by disengaging the first portion from the second portion, the wellbore dart is removable from the sliding sleeve.

12. The artificial lift assembly of claim 10, wherein the wellbore dart comprises: an outer collet tubing forming the outer profile, the outer collet tubing having a plurality of collet fingers which have a radially inward position and a radially outward position, and the radially outward position prevents upward movement of the wellbore dart when it is within the sliding sleeve; and an inner dart mandrel configured to move the collet fingers to the radially outward position.

13. The artificial lift assembly of claim 12, wherein the inner dart mandrel is comprised of the first portion and the second portion, and wherein by disengaging the first portion from the second portion, the inner dart mandrel is removable from the outer collet tubing to thus allow the dart and the outer collet tubing to be removed from the sliding sleeve.

14. The artificial lift assembly of claim 13, wherein the wellbore dart comprises one or more polymeric sealing sections defined on an outer surface, and wherein the sealing sections provide a fluid-tight seal with the inner surface of the sliding sleeve.

15. The artificial lift assembly of claim 14, wherein the outer collet tubing has an upper end having a shoulder and wherein the shoulder interacts with the sliding sleeve so as to prevent downward movement of the wellbore dart past the sliding sleeve.

* * * * *